US009739555B2

(12) United States Patent
Milde, Jr. et al.

(10) Patent No.: US 9,739,555 B2
(45) Date of Patent: Aug. 22, 2017

(54) REMOTE CONTROL WEAPON LOCK

(71) Applicants: Karl F. Milde, Jr., Mahopac, NY (US); Jeffrey A. Matos, New Rochelle, NY (US)

(72) Inventors: Karl F. Milde, Jr., Mahopac, NY (US); Jeffrey A. Matos, New Rochelle, NY (US)

( * ) Notice: Subject to any disclaimer, the term of this patent is extended or adjusted under 35 U.S.C. 154(b) by 0 days.

(21) Appl. No.: 15/211,273

(22) Filed: Jul. 15, 2016

(65) Prior Publication Data

US 2016/0327356 A1 Nov. 10, 2016

Related U.S. Application Data

(60) Continuation-in-part of application No. 15/166,745, filed on May 27, 2016, which is a continuation-in-part of application No. 14/542,889, filed on Nov. 17, 2014, now Pat. No. 9,377,259, which is a continuation of application No. 14/511,222, filed on Oct. 10, 2014, now Pat. No. 9,222,740, which is a division of application No. 13/763,951, filed on Feb. 11, 2013, now Pat. No. 8,893,420.

(60) Provisional application No. 61/761,270, filed on Feb. 6, 2013.

(51) Int. Cl.

| | |
|---|---|
| ***F41A 17/06*** | (2006.01) |
| ***F41A 17/46*** | (2006.01) |
| ***F41A 17/44*** | (2006.01) |

(52) U.S. Cl.

CPC ..... *F41A 17/063* (2013.01); *F41A 17/066* (2013.01); *F41A 17/44* (2013.01); *F41A 17/46* (2013.01)

(58) Field of Classification Search

CPC ..... F41A 17/063; F41A 17/066; F41A 17/06
USPC ..... 42/70.11
See application file for complete search history.

(56) References Cited

U.S. PATENT DOCUMENTS

| | | | |
|---|---|---|---|
| 4,354,189 | A | 10/1982 | Lemelson |
| 4,467,545 | A | 8/1984 | Shaw, Jr. |
| 4,682,435 | A | 7/1987 | Heltzel |
| 4,970,819 | A | 11/1990 | Mayhak |
| 5,062,232 | A | 11/1991 | Eppler |
| 5,448,847 | A | 9/1995 | Teetzel |
| 5,459,957 | A | 10/1995 | Winer |
| 5,461,812 | A | 10/1995 | Bennett |
| 5,502,915 | A | 4/1996 | Mendelsohn et al. |

(Continued)

FOREIGN PATENT DOCUMENTS

| | | | |
|---|---|---|---|
| CA | 2568332 | * | 12/2005 |
| WO | 2008151402 | A2 | 12/2008 |

*Primary Examiner* — Stephen M Johnson
(74) *Attorney, Agent, or Firm* — Karl F. Milde, Jr.

(57) ABSTRACT

A battery-powered trigger-locking device, which is configured to be disposed on a gun with a trigger for firing, includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired. A separate electronic gun key is provided to transmit gun unlock data to the data receiver of the trigger-locking device. This gun unlock data may be a password, a long pseudo-random number or biologic data identifying the gun owner or some other person who is licensed or otherwise authorized to fire the gun.

18 Claims, 10 Drawing Sheets

(56) References Cited

U.S. PATENT DOCUMENTS

| | | | |
|---|---|---|---|
| 5,570,528 | A | 11/1996 | Teetzel |
| 5,603,180 | A | 2/1997 | Houze |
| 5,636,464 | A | 6/1997 | Ciluffo |
| 5,713,149 | A | 2/1998 | Cady et al. |
| 5,828,301 | A | 10/1998 | Sanchez |
| 5,896,691 | A | 4/1999 | Kaminski et al. |
| 5,937,557 | A | 8/1999 | Bowker et al. |
| 6,293,039 | B1 | 9/2001 | Fuchs |
| 6,314,671 | B1 | 11/2001 | Gering |
| 6,415,542 | B1 | 7/2002 | Bates et al. |
| 6,421,943 | B1 | 7/2002 | Caulfield et al. |
| 6,499,243 | B1 | 12/2002 | Herzog |
| 6,711,843 | B2 | 3/2004 | Klebes |
| 6,711,844 | B2 | 3/2004 | Rumfelt |
| 6,763,126 | B2 | 7/2004 | Recce |
| 6,785,995 | B2 | 9/2004 | Herzog et al. |
| 6,823,621 | B2 | 11/2004 | Gotfried |
| 6,861,944 | B1 | 3/2005 | Hoepelman |
| 7,030,729 | B2 | 4/2006 | Albanesi et al. |
| 7,339,456 | B1 | 3/2008 | Buckley et al. |
| 7,353,632 | B2 | 4/2008 | Newkirk et al. |
| 7,356,959 | B2 | 4/2008 | Schmitter et al. |
| 8,205,372 | B2 | 6/2012 | Anzeloni |
| 8,205,375 | B1 | 6/2012 | Anzeloni |
| 2001/0032405 | A1 | 10/2001 | Kaminski |
| 2001/0042332 | A1 | 11/2001 | Gering et al. |
| 2002/0021206 | A1* | 2/2002 | Wootton ..... F41A 17/063 340/5.61 |
| 2002/0157296 | A1 | 10/2002 | Vivian et al. |
| 2002/0174587 | A1 | 11/2002 | Rumfelt |
| 2004/0244253 | A1 | 12/2004 | Glock |
| 2007/0074438 | A1 | 4/2007 | Parhofer et al. |
| 2007/0241010 | A1 | 10/2007 | Giebel et al. |
| 2008/0039962 | A1 | 2/2008 | McRae |
| 2008/0134556 | A1 | 6/2008 | Remelin |
| 2008/0244699 | A1 | 10/2008 | Parhofer et al. |
| 2009/0223104 | A1 | 9/2009 | Anzeloni |
| 2011/0056108 | A1 | 3/2011 | McCord et al. |
| 2011/0061280 | A1 | 3/2011 | Emde et al. |
| 2011/0173869 | A1 | 7/2011 | Uhm |
| 2012/0151814 | A1 | 6/2012 | Dietel |
| 2012/0180357 | A1 | 7/2012 | Dietel et al. |
| 2013/0125441 | A1 | 5/2013 | Westwood et al. |
| 2013/0312306 | A1 | 11/2013 | Ruffin |
| 2014/0215885 | A1 | 8/2014 | Sullivan et al. |
| 2014/0230301 | A1 | 8/2014 | Chance et al. |

* cited by examiner

REMOTE CONTROL WEAPON LOCK

CROSS-REFERENCE TO RELATED APPLICATIONS

This application claims priority from the U.S. Provisional Application No. 61/761,270 filed Feb. 6, 2013, and entitled "SECURE SMARTPHONE-OPERATED GUN TRIGGER LOCK;" the U.S. patent application Ser. No. 13/763,951 filed Feb. 11, 2013, entitled "SECURE SMARTPHONE-OPERATED GUN TRIGGER LOCK" (now U.S. Pat. No. 8,893,420); U.S. patent application Ser. No. 14/511,222 filed Oct. 10, 2014, entitled "SECURE SMARTPHONE-OPERATED LOCKING DEVICE" (which is a division of aforesaid U.S. application Ser. No. 13/763,951 and is now U.S. Pat. No. 9,222,740); U.S. patent application Ser. No. 14/542,889 filed Nov. 17, 2014, entitled "REMOTE CONTROL WEAPON LOCK" (which is a continuation of aforesaid U.S. application Ser. No. 14/511,222 and is now U.S. Pat. No. 9,377,259) and U.S. patent application Ser. No. 15/166,745, filed May 27, 2016 and entitled "REMOTE CONTROL WEAPON LOCK", which is a continuation-in-part of the aforesaid U.S. application Ser. No. 14/542,889. This application is a continuation-in-part of the aforesaid application Ser. No. 15/166,745.

BACKGROUND OF THE INVENTION

The present invention relates to a weapon lock, such as, for example, a gun lock for a trigger-operated gun which is designed to be installed on the gun; e.g., in a position behind the trigger to prevent the trigger from firing the gun.

Mechanical gun locks are designed to be installed on the gun in a position behind the trigger to prevent the trigger from firing the gun. These gun locks use a mechanical key that can be easily duplicated, and the locks themselves can be compromised by means of a master key or a lock pick.

Furthermore, such gun locks can be opened by anyone in possession of one of the keys. With such gun locks it is not possible to restrict the use of the gun to the gun owner or to some other person who is licensed or otherwise authorized to use the gun.

SUMMARY OF THE INVENTION

It is a principal object of the present invention to provide a gun safety system for a trigger-operated gun which is difficult to compromise and allows only the gun owner, or some other person who is licensed or otherwise authorized, to use the gun.

This object, as well as other objects which will become apparent from the discussion that follows, is achieved, in accordance with the present invention, by providing a battery-powered trigger-locking device which is configured to be disposed on a gun of the type having a trigger for firing. The trigger-locking device includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired.

According to a preferred embodiment of the invention, the gun safety system according to the invention further comprises an electronic gun key having a data transmitter for transmitting gun unlock data to the data receiver of the trigger-locking device. This gun unlock data may be a password, a long pseudo-random (and therefore hack-resistant) number and/or biologic data identifying the gun owner or some other person who is licensed or otherwise authorized to use the gun.

More particularly, the gun safety system comprises:

(1) a gun lock device, configured to be installed on a gun and which includes:

(a) an electric gun lock configured to be disposed on a gun and responsive to an electronic gun command signal to select a state from among at least two operative states, including a locked state which prevents firing the gun and an unlocked state which enables firing;

(b) a first data memory for storing first gun security data representing (i) gun key information pertaining to at least one gun key device that may be used to control the gun, and (ii) biologic personal information pertaining to at least one authorized person who is permitted to control the gun and can thus select either the locked or the unlocked operative state;

(c) a first data receiver for receiving a gun control signal including second gun security data; and (d) a first logic device, coupled to the first data receiver and to the first data memory, for (i) generating the second gun security data from the received gun control signal;

(ii) comparing the second gun security data with the first gun security data stored in the first data memory, and (iii) producing the electronic gun command signal to select one of the locked and the unlocked operative states when the first gun security data and the second gun security data are substantially the same; and (2) a first gun key device for controlling the gun lock device which comprises:

(a) a first data transmitter for transmitting the gun control signal to the first data receiver;

(b) a second data memory for storing second gun security data representing (i) first gun key information pertaining to the first gun key device, and (ii) biologic personal information pertaining to at least one authorized person who is permitted to control the gun and thereby to select one of the locked and the unlocked operative states; and (c) a second logic device, coupled to each of the first data transmitter and the second data memory, for generating the gun control signal, including the second gun security data stored in the second data memory, for transmission to the first data receiver.

The first logic device is operative to cause the gun lock device to select one of the operative states when the first gun security data stored in the first data memory are substantially the same as the second gun security data received from the gun key device. The putative authorized person is therefore recognized as an authorized person only in the event that the second gun security data transmitted by the gun key device substantially matches the first gun security data stored in the first data memory, thereby preventing unauthorized use of the gun.

The first logic device, upon producing the electronic command signal, may cause the gun lock to select the unlocked state for a first duration of time, and thereafter select the locked state. The first duration of time is preferably selected from the group consisting of:

less than 1 minute;

(ii) a range of time from 1 minute to 5 minutes;

(iii) a range of time from more than 5 minutes to 30 minutes; and (iv) more than 30 minutes.

In an alternative embodiment of the invention, the unlocked state remains until another command signal is received by the data receiver to lock the gun.

A gun key device has a data transmitter for transmitting the gun control signal to the gun lock device. The gun control signal may include a password, a pseudo-random number and/or biologic data identifying a putative authorized person who wishes to use the gun. The pseudo-random number is preferably generated by the gun key device when the gun is first used.

According to a preferred embodiment of the invention, the gun lock device further comprises a second data transmitter connected to the first logic device and the gun key device further comprises a second data receiver connected to said second logic device, and wherein:

(i) the second logic device is further operative to generate a gun key interrogation signal;

(ii) the first data transmitter is operative to transmit the gun key interrogation signal to the first data receiver;

(iii) the first logic device is further operative to generate a reply signal;

(iv) the second data transmitter is operative to transmit the reply signal to the second data receiver; and (v) the second logic device is operative to generate a gun control signal for transmission to the first data receiver in the gun lock device only if a reply signal is received in response to said interrogation signal.

This arrangement allows access to the gun lock only by a properly identified gun key device.

Alternatively or in addition, the gun key device may comprise:

(a) an input device, for inputting information from a putative authorized person who wishes to unlock the gun; and (b) a second logic device, coupled to both the data transmitter and the input device, for generating gun unlock data defined by the putative authorized person and for causing the data transmitter to transmit the gun unlock data to the data receiver. The putative authorized person is recognized as an authorized person if the gun unlock data substantially matches the stored data in the trigger lock data memory.

When a biologic identifier is used to unlock the gun lock, the data stored in the memory of the gun lock device may include at least one biologic identifier of the owner or an authorized person.

The gun key device may include an input device, which may be a camera, for example. In this case, the camera is operative to record an image of the putative authorized person as a biologic identifier, which image may be:

a facial image;

an image of an iris;

a retinal image;

a fingerprint;

a palm print; and an image of veins of a hand. The second logic device is then operative to process the image and to generate the gun unlock data therefrom.

Alternatively, the input device may be a microphone. The second logic device is then operative to process a voiceprint of the putative authorized person as a biologic identifier and to generate the gun unlock data therefrom.

Finally, the input device may be an alphanumeric keyboard, whereby:

the putative authorized person may input an alphanumeric code; and (ii) the putative authorized person is recognized as an authorized person in the event the inputted code matches the stored data.

The gun lock device preferably comprises a first battery for providing power to at least one of the first logic device, the first data receiver and the first data memory and a second battery for providing power to an electromechanical apparatus for locking and unlocking the gun, which apparatus is power thirsty compared to the electronic devices.

Preferably, an electric device is provided for selectively utilizing the still-functional battery when one of the two batteries is depleted.

Preferably also, the electromechanical apparatus is operative to move a movable member to a position of the locked state, in the event of battery depletion.

Advantageously, the first data memory comprises at least one write-once-only element to prevent degradation of the data stored in the memory and to prevent the data stored in the memory from being changed. The write-once-only element may be a PROM, an EPROM or an EEPROM, for example.

According to a preferred embodiment of the invention, the gun lock apparatus comprises at least one tamper detecting device, situated in proximity to the gun lock device, for detecting external manipulation of at least one of (1) the first logic device and the (2) electromechanical apparatus for locking and unlocking the gun. This tamper detecting device preferably generates a tamper signal upon the detection of the external manipulation, which tamper signal causes the electromechanical apparatus to maintain the movable member in the first position for a second duration of time. The tamper detecting device may be a separate element or it may be implemented by the first logic device.

Advantageously, the gun lock device comprises a transmitting device, coupled to the tamper detecting device, for transmitting an alarm upon generation of the tamper signal.

According to still another preferred embodiment of the present invention, the first data memory may be operative to store identifying information of a registration person authorized to input data to the first data memory which identifies the authorized person. In this case, the first logic device is made operative to store data concerning a person authorized to use the gun, in the first data memory only if the authorized person identification information is accompanied by identification of a putative registration person that substantially matches the stored registration person identification information. Also, the first logic device is made operative to change the data stored in the first data memory only if the identification information is accompanied by identification of a putative registration person that substantially matches the stored registration person identification information.

Finally, according to still another preferred embodiment of the present invention, the electromechanical apparatus includes an electric motor coupled to a gear reduction mechanism for rotating a cam. A movable member of the gun lock device is moved by the cam between the locked position and the unlocked position.

Alternatively, the electric motor may be a servo-motor which is coupled mechanically to the movable member to move this member back and forth between the two positions (locked state and unlocked state).

In yet another alternative embodiment of the invention, an electromagnetically controlled two position switching device may be used to control the position of movable member.

For a full understanding of the present invention, reference should now be made to the following detailed description of the preferred embodiments of the invention as illustrated in the accompanying drawings.

BRIEF DESCRIPTION OF THE DRAWINGS

FIG. 5, comprising

DETAILED DESCRIPTION OF THE PREFERRED EMBODIMENTS

Figure 1:
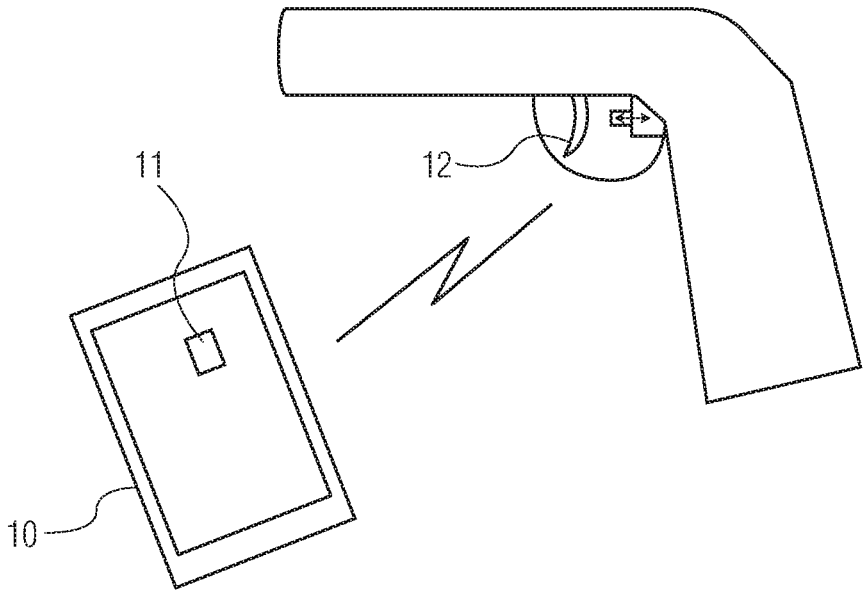
FIG. 1 is a representational diagram showing a smartphone and a gun that is equipped with a gun lock according to the present invention.

The preferred embodiments of the present invention will now be described with reference to FIGS. 1-7 of the drawings. Identical elements in the various figures are identified with the same reference numerals.

Briefly in overview, a battery-operated trigger-locking device is permanently attached to/installed in a gun in a recess behind the trigger in the lower receiver mechanism. In its default condition, a movable member is in a blocking position, preventing movement of the trigger. When unlocked, the movable member is drawn rearward, or otherwise removed from its blocking position, to allow movement of the trigger.

The trigger-locking device has a Bluetooth (or other type) receiver and a storage device for storing personal information identifying an authorized user of the gun. When this particular information is received from a smartphone or similar device, the trigger-locking device removes the movable member from the blocking position, releasing the trigger.

FIG. 1 shows a preferred embodiment of this configuration. A smartphone 10 has an App 11, perhaps called "Gunlock," that presents a separate button called "Gun Unlock" for each gun the smartphone owner owns or is licensed to use. By pressing the button on the App, the owner sends a password, a pseudo-random number or biologic ID data by a Bluetooth or Wifi wireless connection to a trigger-locking device 12 installed in, or on, a gun.

Figure 2:
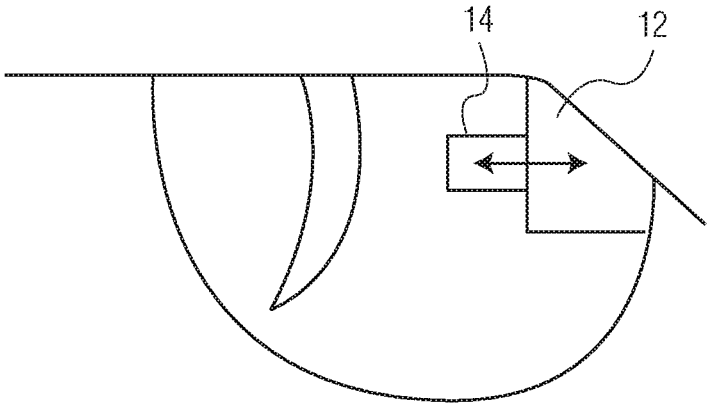
FIG. 2 is a close-up view of the trigger region of the gun of FIG. 1 with the gun lock installed.

FIG. 2 shows a preferred embodiment of the trigger-locking device 12 having a movable member 14. When the device receives a data packet that matches the corresponding data stored in its memory, it draws the movable member 14 back, allowing the trigger to fire the weapon.

The smartphone can be made secure in any number of ways. It can be password protected or, preferably, it can make use of its camera to verify the ID of the person holding this device. For example, the security App may use face recognition or iris recognition software to identify the owner from the camera image. The smartphone can also incorporate a fingerprint sensor, a voiceprint sensor, or other means to identify its user and ensure that the smartphone user is authorized to utilize the smartphone functions.

When the trigger lock 12 is first used, the Gunlock App can generate a pseudo-random number, a password, or a biologic (biometric) signature identifying a person authorized to use the gun and send it to the trigger-locking device for storage in its permanent memory. Once stored, this number, password or biologic identification can be changed only by the authorized person, such as the gun owner, or by a "registration person" who is duly licensed to perform this function, e.g. by a local or national government. Thereafter, whenever the smartphone sends this number, password or biologic identification again, the trigger-locking device performs a comparison and releases the trigger lock if and only if a match is found so the gun may be fired. Before sending the unlock number, password or biologic identification information, the user of the smartphone may be required to identify himself/herself by entering into the phone the same or another number, a password, a biologic identifier or some other identifying information, such as the answer to a personal question. Alternatively, the user may use the smartphone to capture his or her own biologic identifying information such as one or more of the following:

a facial image;
an image of an iris;
a retinal image;
a fingerprint;
a palm print; and
an image of veins of a hand.

Either the biologic identifying information pre-stored in the smartphone, or the newly captured biologic identifying information, or both, may be sent to the trigger-locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identity with the smartphone; and
(2) Press the Gun Unlock button to enable the trigger lock to release the trigger.

The trigger remains unlocked until the gun user presses another button on the Gunlock app, appropriately called "Gun Lock," or until the trigger lock times out and automatically locks itself by restoring the movable member to the locked position.

The trigger-locking device 12 is preferably powered by a replaceable and/or rechargeable battery (not shown).

Figure 3:
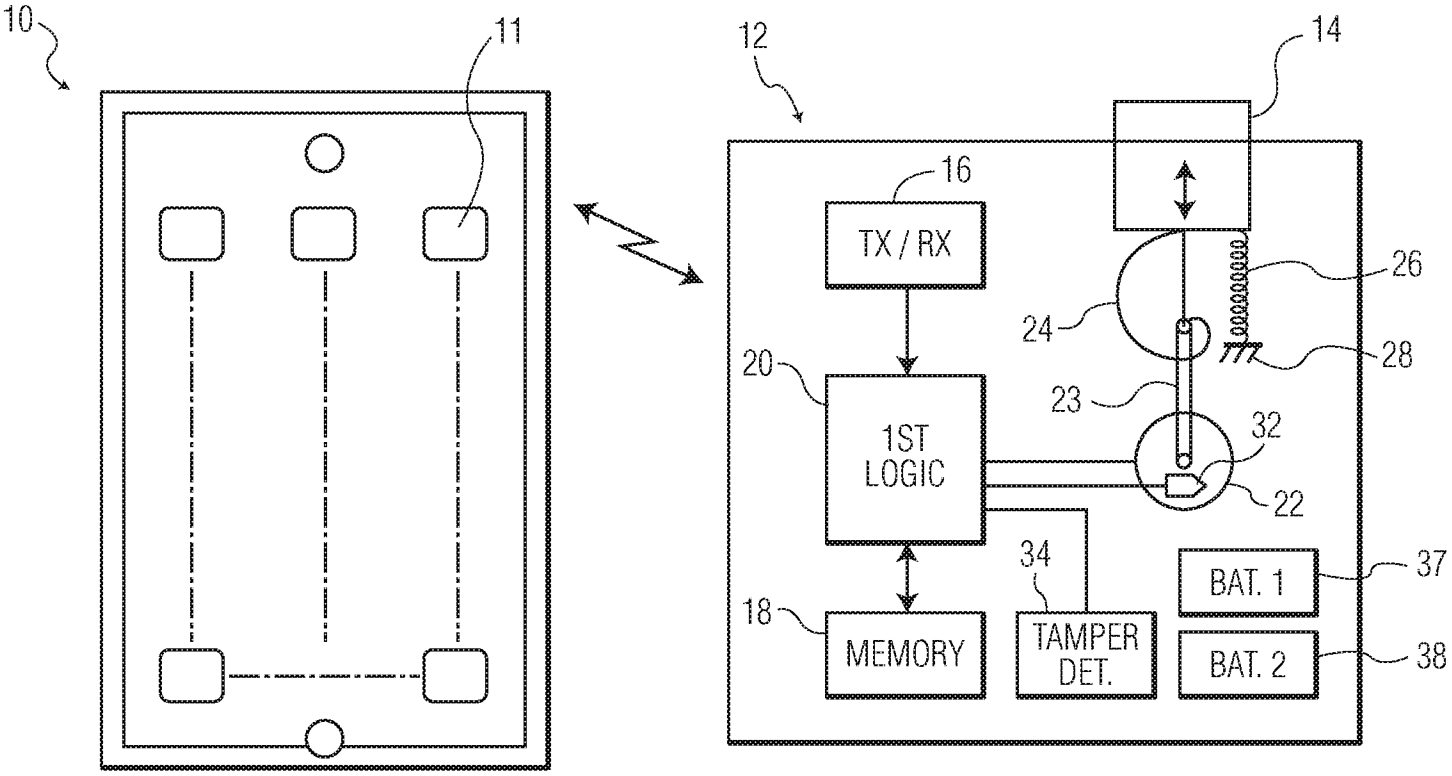
FIG. 3 is a block diagram showing a preferred embodiment of the gun lock apparatus according to the present invention.

FIG. 3 shows the individual elements of the gun lock apparatus. The smartphone 10 transmits to a receiver 16 in the trigger-locking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone is indeed the owner of the gun.

The electromechanical device is preferably a micro-motor 22 that turns a shaft 23 through a speed reduction gear mechanism. In this way, a very small motor may generate sufficient torque to move the movable member 14 between a locked position, adjacent the gun trigger, and an unlocked position which permits the trigger to fire the gun. The relatively large forces that may be applied against the movable member by the trigger when in the locked position are taken up by a rotatable cam 24, that presses against the movable member against the force of a spring 28. The spring 28, which is connected to a stationary member attached to the gun, biases the movable member 14 toward the unlocked position. The cam 24 abuts a cam surface on the underside of the movable member 14 and, as it rotates, it moves the movable member toward the locked position adjacent the trigger.

Figure 4:
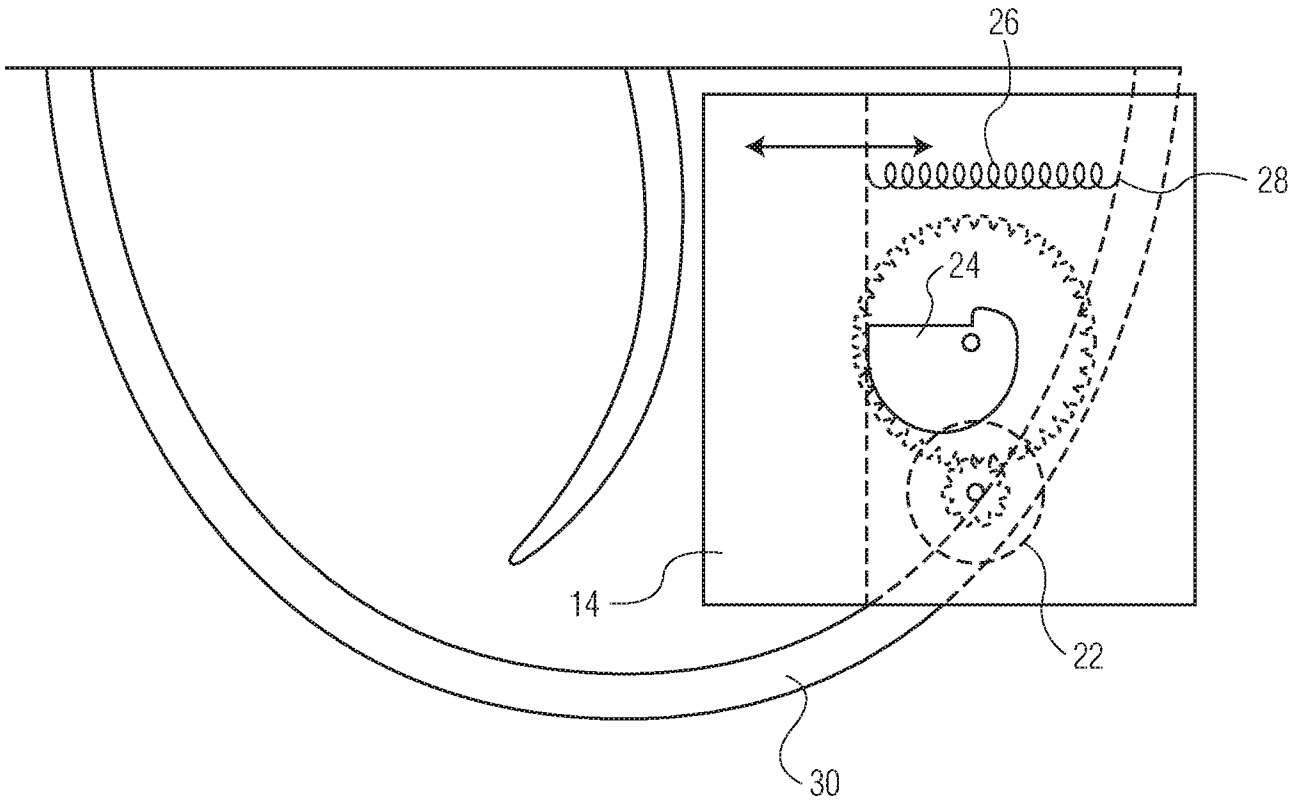
FIG. 4 is a detailed, representational diagram showing a preferred embodiment of the trigger-locking device of the present invention.

FIG. 4 illustrates this electromechanical mechanism in greater detail. The cam 24 is arranged on the reduction gear 23 which is driven by a small gear on the shaft of the motor 22. The spring 26, which is attached at 28 to the trigger guard 30, biases the moveable member in the unlocked position. The cam presses against a flat surface 32 on the inside of the moveable member 14 to move the member 14 to the locked position.

Alternatively, a servo-motor can be substituted for the motor and cam mechanism to move the movable member 14.

The movable member 14 surrounds the trigger guard 30 of the gun in such a way as to prevent tampering. Preferably a tamper detecting device is provided which signals the logic device 20 when it detects tampering so that this device can (1) signal the motor 22 to move the movable member 14 into the locked position, and (2) sound or transmit a warning signal.

Figure 5A:
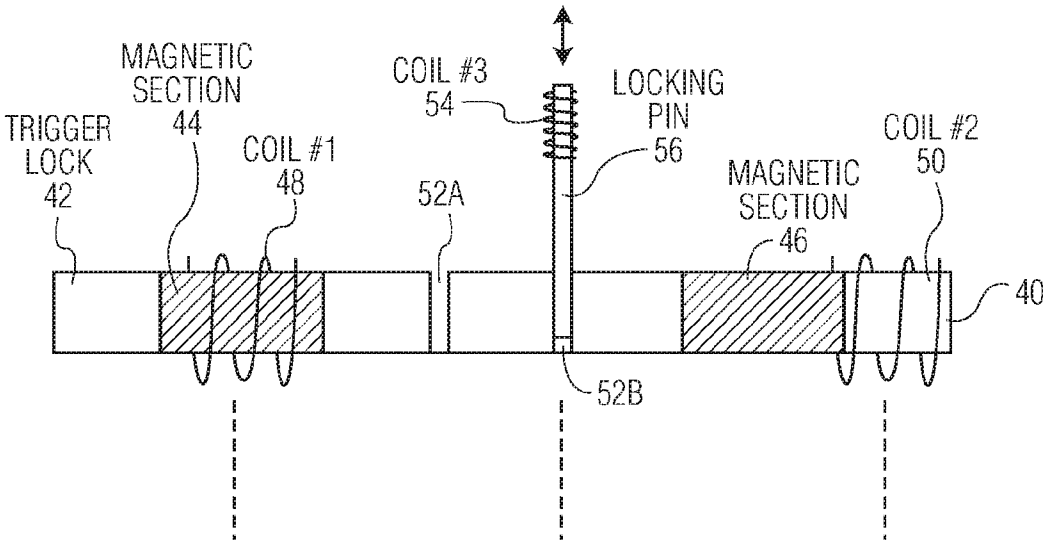
FIGS. 5A and 5B, is a representational diagram showing an alternative embodiment of the electromechanical apparatus used in the trigger-locking device.

FIG. 5 illustrates an alternative embodiment of the electromechanical apparatus for locking and unlocking the trigger-locking device. FIG. 5A shows a movable armature 40 in the locked position (i.e., moved linearly to the left in the figure). This armature presses against the moveable member 14 of the locking device, preventing actuation of the gun trigger. Sections 44 and 46 of the armature contain magnetic material that is actuated by coils 48 and 50. The armature is held in position by a locking pin 56 that is selectively pressed by a third coil 54 into receptacles or detents 52A and 52B in the armature to fix the armature in the unlocked and locked positions, respectively.

Figure 5B:
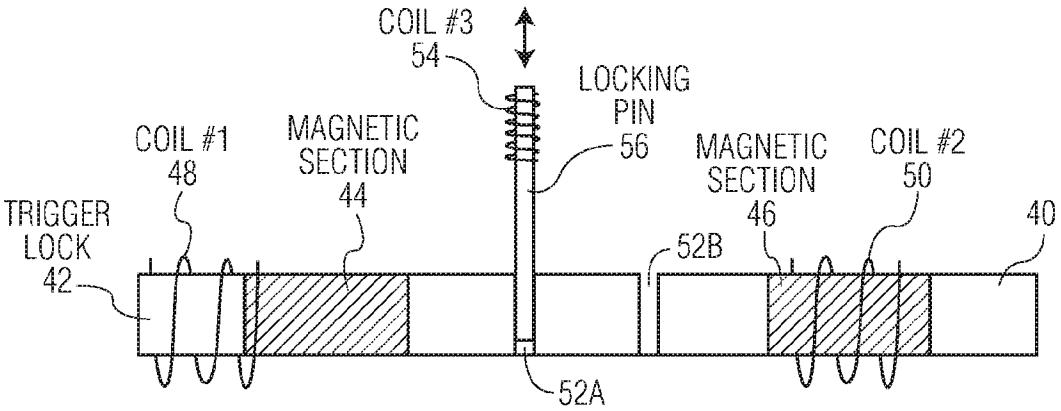

FIG. 5B shows the armature in the unlocked position (moved to the right in the figure).

There are a number of ways that a gun, or any other type of weapon, can be prevented from firing or otherwise rendered inoperative. In addition to the trigger locks described above, or in place thereof, the muzzle of a gun can be closed off by insertion of a blocking member to prevent passage of a munition projectile. Alternatively, or in addition, the weapon can be rendered inoperable by ignition of a pyrotechnic device that melts or otherwise destroys a critical part of the weapon's firing mechanism or its munition loading mechanism.

Figure 6:
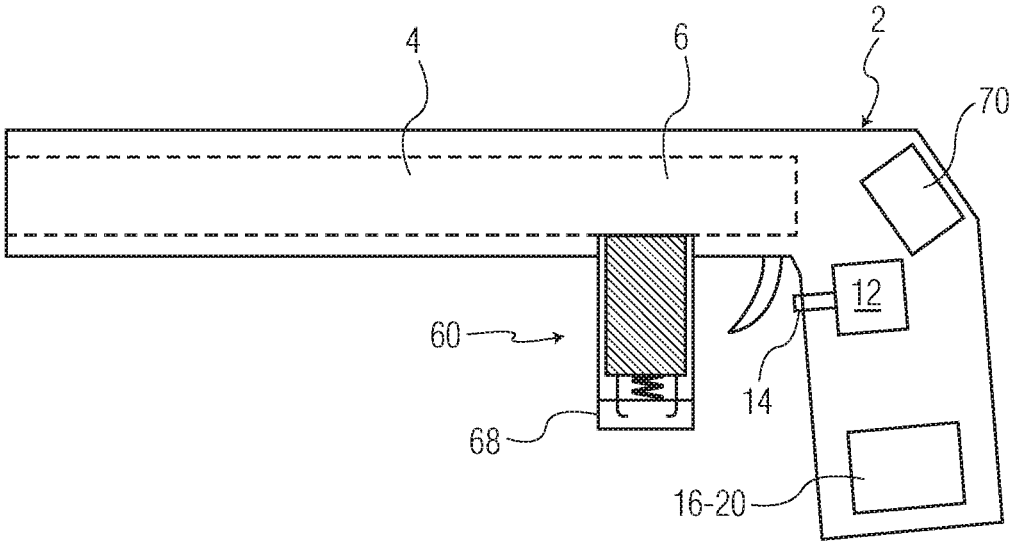
FIGS. 6 and 6A show an exemplary embodiment of a gun with a blocking device and a pyrotechnic device as alternative means for rendering the weapon inoperative.
Figure 6A:
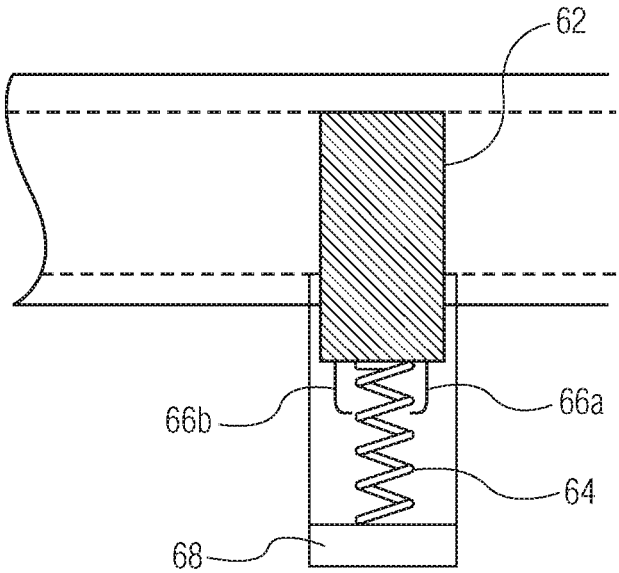

FIGS. 6 and 6A show an exemplary embodiment of a gun with both a blocking device 60 and a pyrotechnic device 70. FIG. 6 shows the unblocked configuration, and the relationship of the blocking device to the gun/weapon; FIG. 6A shows the blocked configuration, and details of device 60. The blocking device 60 comprises a blocking member 62 which is retained in the unblocked position against the force of a spring 64, displaced from the muzzle 4 of a gun 2, by means of hooks 66*a* and 66*b* that are secured by a release mechanism 68. When a gun control signal is received by the electronic system 16, 18 and 20 built into the gun, the gun security data are compared to the stored security data. If a match is found, thus validating the control signal, and if the control signal includes a "blocking" command, the hooks 66*a* and 66*b* are released by the mechanism 68 allowing the spring 64 to press the blocking member into a blocking position (FIG. 6A) of the gun muzzle 4. If the gun is of a breech loading type, the blocking member may be inserted directly into the rear chamber 6; In an alternate embodiment of the invention it may be inserted just ahead of the projectile chamber 6 to block the path of a projectile.

Upon receipt and validation of control signal with an "unblock" command, the blocking member can be manually reset to its original, unblocked position so that the gun is again ready for use.

The pyrotechnic device 70 is operative to permanently disable the gun 2. When it receives a validated command from the electronic system 16-20, it ignites and either explodes or generates sufficient heat to soften or melt critical parts of the gun mechanism to render them inoperative.

In another embodiment of the invention involving breech loading gun configurations, one or more locking devices may be utilized to prevent (or allow) the insertion of a munition into the barrel of the gun. Exemplary representative diagrams of such locking arrangements are shown in FIGS. 7A, 7B and 7C.

Figure 7A:
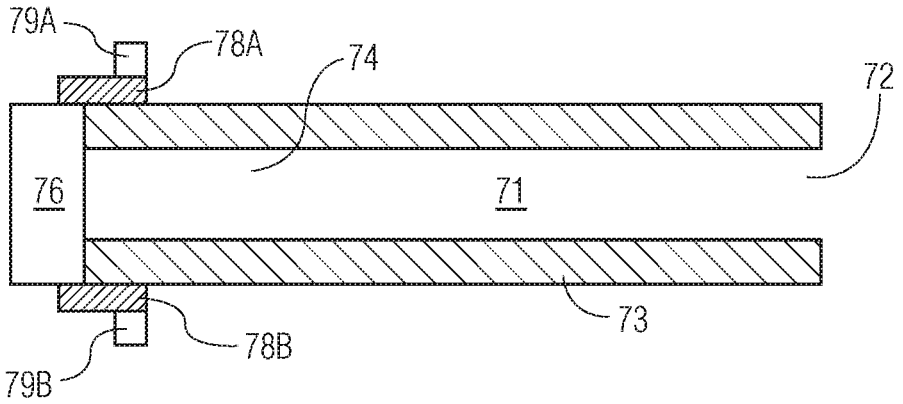
FIGS. 7A, 7B and 7C are representational diagrams showing further exemplary embodiments of a breech-loading artillery weapon with means for blocking insertion of a munition.

FIG. 7A shows a cross sectional view of a gun barrel 71 with a muzzle end 72 and a breech end 74. Door 76 is configured to be opened to allow for the insertion a munition such as an artillery shell. Locking apparatus 78A and 78B, in the locked state, prevent the opening of door 76 and thereby prevent the insertion of the shell into the breech end, 74, of the barrel. In the unlocked state, door 76 may be opened to permit shell insertion. Lock control devices 79A and 79B determine the state of locks 78A and 78B respectively, in response to one or more signals indicating whether a user of the gun has been properly identified.

Figure 7B:
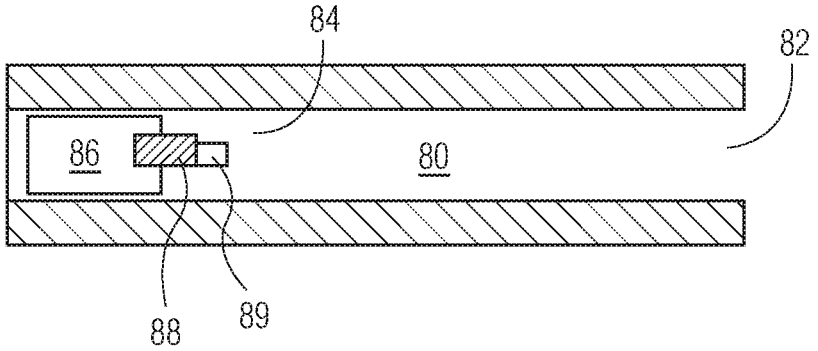

FIG. 7B shows a cross sectional view of a gun barrel 80 with a muzzle end 82 and a breech end 84. Door 86 is configured to be opened to allow for the insertion a munition such as an artillery shell. Locking apparatus 88, in the locked state, prevents the opening of door 86 and thereby prevents the insertion of the shell into the breech end 84 of the barrel. In the unlocked state, 86 may be opened to permit shell insertion. Lock control device 89 determines the state of lock 88, in response to one or more signals indicating whether a user of the gun has been properly identified.

Figure 7C:
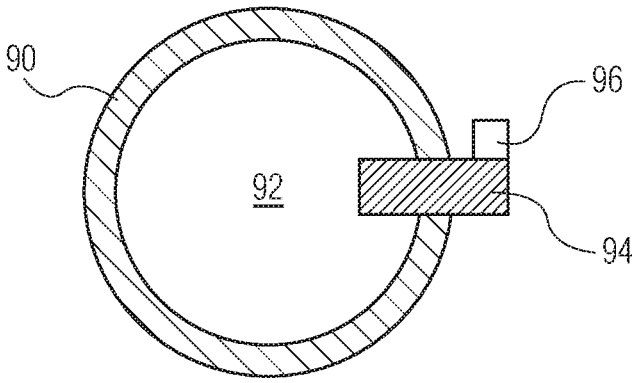

In still another embodiment, FIG. 7C shows a rear view of the breech end of a gun barrel 90. Door 92 is configured to be opened to allow for the insertion a munition such as an artillery shell. Locking apparatus 94, in the locked state, prevents the opening of door 92 and thereby prevents the insertion of the shell into the breech end of the barrel 90. In the unlocked state, 94 may be opened to permit shell insertion. Lock control device 96 determines the state of lock 94, in response to one or more signals indicating whether a user of the gun has been properly identified.

In each of FIGS. 7A-7C, neither (i) the number of locks, (ii) the position and orientation of the lock or locks, (iii) the spatial/geometric arrangement for introducing a shell or munition into the barrel, nor (iv) the locking mechanism, should be considered specific or limiting.

In general, depending upon the type of weapon, be it a handgun, rifle, automatic rifle or artillery weapon such as a mortar, cannon or the like, or even an grenade or bomb, and be it incendiary or a non-incendiary device that delivers a lethal or non-lethal charge, other mechanisms and configurations for rendering a weapon inoperative will occur to those skilled in the art.

Even though a weapon, such as a gun, may be provided with a remote controllable lock, a muzzle block and/or even a pyrotechnic device that can self-destroy, such safety measures would be useless if they are compromised. It is therefore recommended that the weapon also be provided with tamper resistant features such as means for detecting any attempt to block their operation. In so doing, if an unauthorized third party were to attempt to render the safety devices inoperable, the devices would enter their default "fail safe" mode, which is to lock, to block and/or to destroy the weapon.

The tamper resistant features preferably include:

(1) Frangible conductors hidden within the weapon which break a circuit and alert the logic device of an attempt to disassemble or otherwise compromise critical parts of the weapon, such as the safety devices themselves;

(2) Repeated wireless "pinging" of the weapon, the absence of which is detected to determine whether the wireless receiver of the weapon has been placed in a Faraday cage or otherwise compromised to prevent receipt of a disable signal; and (3) Detection of loss of the primary batter power to the safety devices, through the use of emergency back-up power.

Other tamper detection and tamper resistant features will occur to those skilled in the art.

Figure 8:
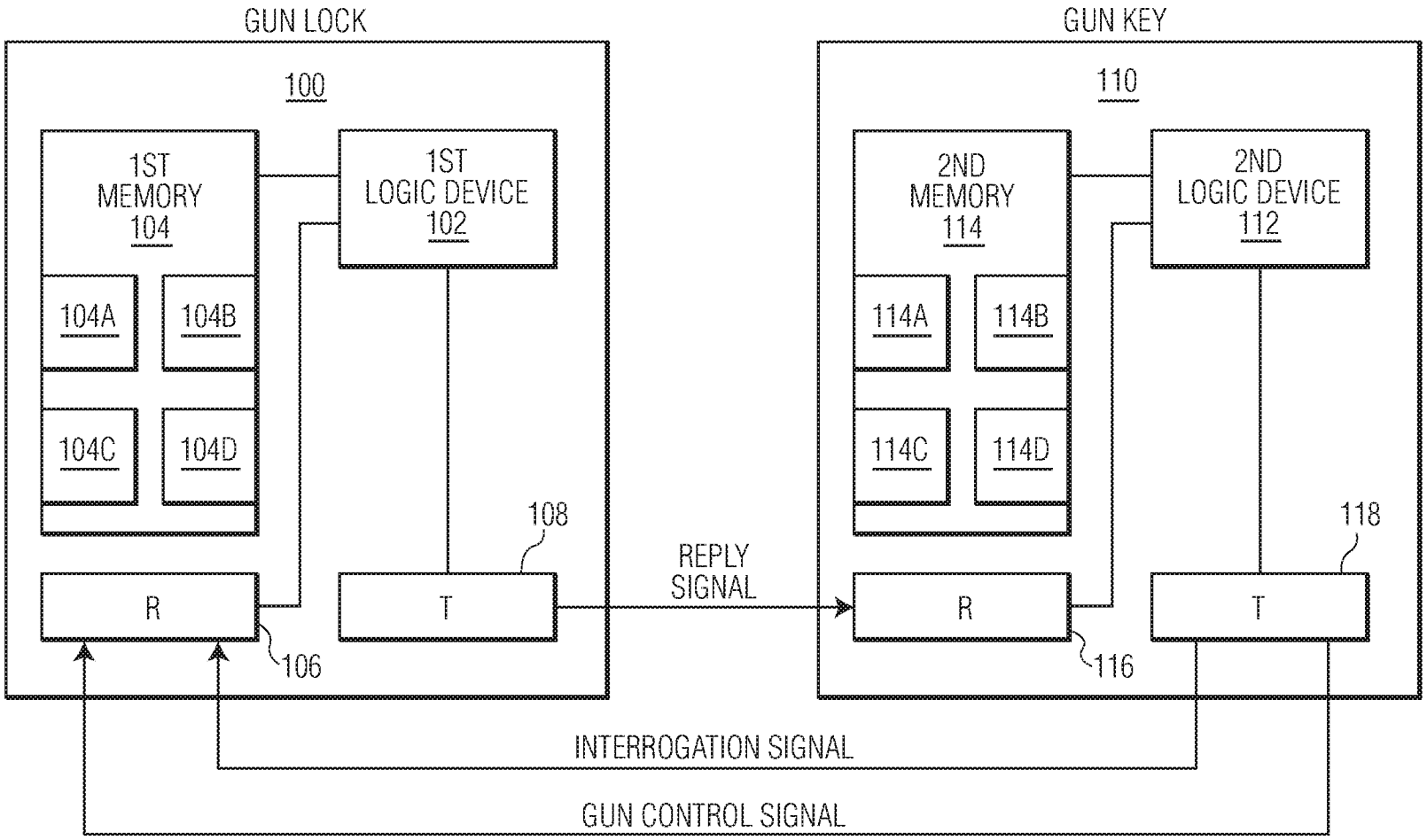
FIGS. 8-11 are block diagrams showing additional preferred embodiments of the invention.
Figure 9:
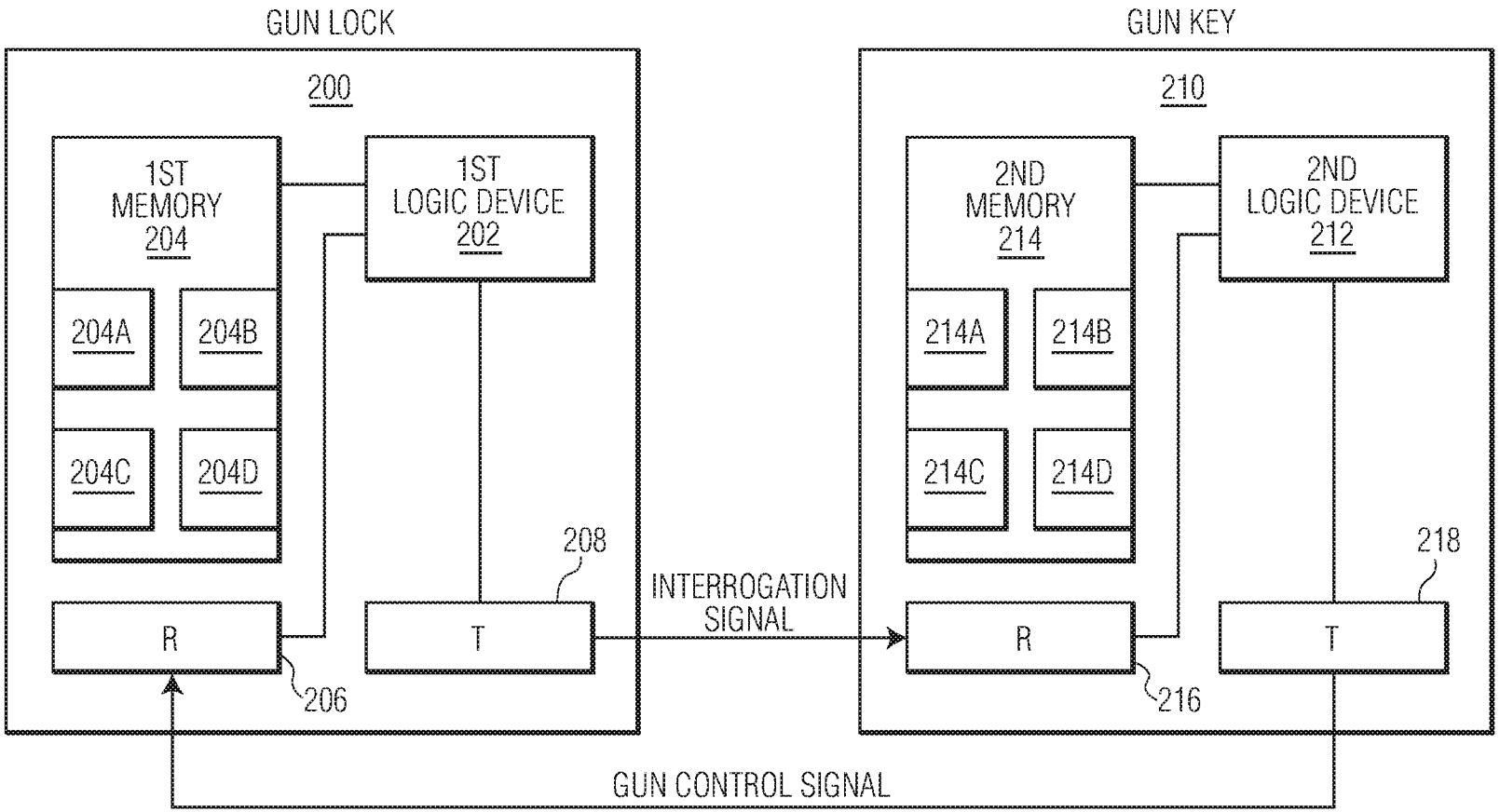

FIGS. 8-9 show apparatus for increasing the security while carrying out the communications between a gun key and a gun lock. In addition to an approach which continuously or semi-continuously provides the biologic identification of a potential user ("a putative authorized person") of the gun key to the gun lock, the approaches of FIGS. 8 and 9 illustrate two more families of approaches, which provide the biologic identifier of the user only after certain other conditions are met. The other conditions include:

- proximity between the gun key and the gun lock device;
- the identification of a particular gun lock by a particular gun key based on product identification information; and
- the identification of a particular gun key by a particular gun lock, based on product identification information.

FIG. 8 shows a gun key 110 which transmits an interrogation signal from its transmitter 118 to the receiver 106 of a gun lock. Upon receipt of the interrogation signal, the first logic device 102 of the gun lock causes the transmitting device 108 of the gun lock to provide a reply signal which is received by the receiving device 116 of the gun key. Only upon receipt of the reply signal by second logic device 112 or the gun key, is the biologic identification information (as part of a gun control signal requesting either locking or unlocking of the gun) of the gun key sent to the gun lock. With such a configuration, the biologic ID information is not sent out to the gun lock, unless the gun lock responds appropriately to the interrogation signal sent by the gun key.

The interrogation signal sent by the gun key could be a generic one, simply requesting confirmation of the proximity of the gun lock to the gun key. Or it could involve alphanumeric code, or a product code 114A stored in gun key memory 114. The reply signal would be sent by the gun lock only if there is a matching alphanumeric or product code 104A stored in the first memory 104 of the gun lock. The product code stored in 104A and 114A could pertain to either the gun lock, or the gun key or both.

Other items stored in the first memory 104 include biologic identification information of one or more allowed users of the gun 104B, alphanumeric identification 104C of such users, and operating system information, 104D. Similarly, other items stored in the second memory 114 include biologic identification information of one or more allowed users of the gun 114B, alphanumeric identification 114C of such users, and operating system information, 114D.

In addition, embodiments of the invention in which the gun key device does not send the gun control signal (even if the interrogation and reply steps were properly executed) unless a properly device-identified product number (stored in 104A) is contained in the reply signal (with proper identification based on matching data stored in 114A). Such a product ID could be either a gun lock ID number, a gun key ID number, or both.

FIG. 9 illustrates another embodiment in which biologic identification release is withheld until a preliminary communication between the gun lock and gun key has occurred. In this case, an initial interrogation signal is sent from the transmitting device 208 of gun lock 200 to the receiving device 216 of gun key 210. Logic device 212 then causes transmitting device 218 of the gun key to provide the gun control signal (including biologic identification information of the user) to receiving device 206 of the gun lock.

The interrogation signal sent by the gun lock could be a generic one, simply requesting confirmation of the proximity of the gun key to the gun lock. Or it could involve alphanumeric code, or a product code 204A stored in gun lock memory 204. The gun control signal would be sent by the gun lock only if there is a matching alphanumeric or product code 214A stored in the second memory 214 of the gun key. The product code stored in 204A and 214A could pertain to either the gun lock, or the gun key or both.

Other items stored in the first memory 204 include biologic identification information of one or more allowed users of the gun 204B, alphanumeric identification 204C of such users, and operating system information, 204D. Similarly, other items stored in the second memory 214 include biologic identification information of one or more allowed users of the gun 214B, alphanumeric identification 214C of such users, and operating system information, 214D.

Figure 10:
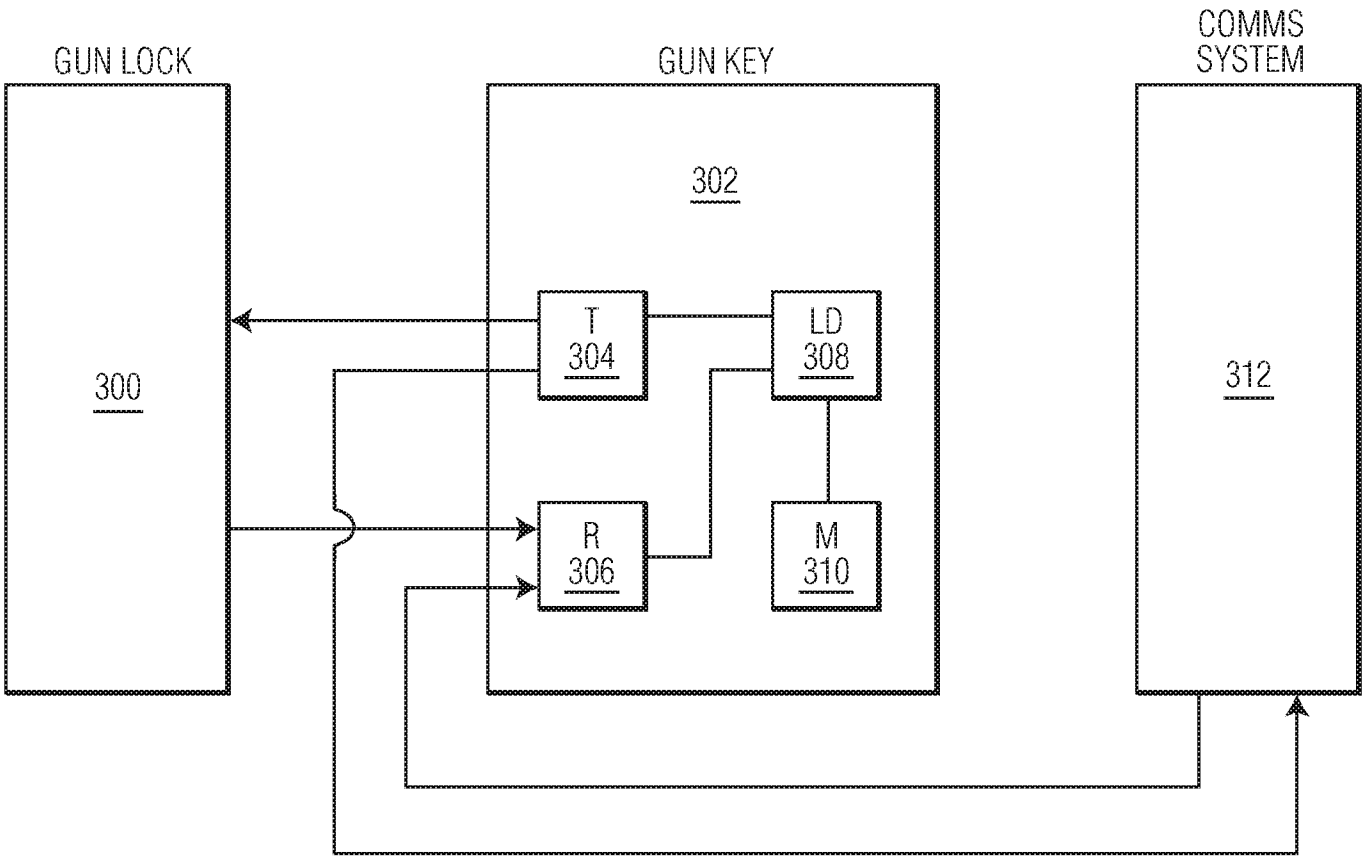
Figure 11:
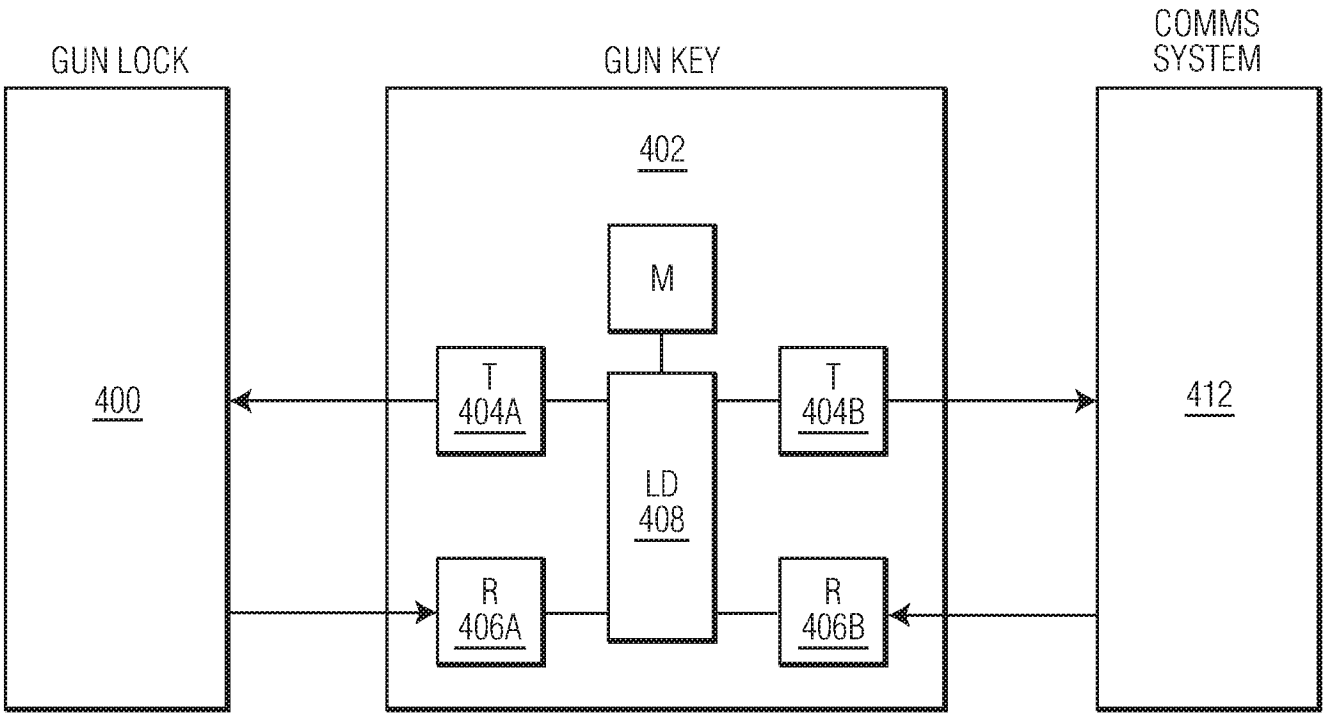

FIGS. 10 and 11 show apparatus which allows a gun key to communicate with devices in addition to the gun lock.

In FIG. 10, the gun key 302 has a transmitting device 304 which is operative to communicate not only with gun lock 300 but also with communications system 312. Similarly, gun key receiving device 306 is operative to communicate not only with gun lock 300 but also with communications system 312. The communication system could be a server, a portion of a local communications network, the internet, a public telephone network or another system. The gun key could thus be either a standalone device, an "APP" or program running on a cell phone or a so-called smartphone or other multifunction communications device, or part of an APP or program. The figure shows control of 304 and 306 by logic device 308. The function of memory 310 is as recited hereinabove.

FIG. 11 shows another embodiment of the inventive theme of FIG. 10, i.e. indicating that the gun key may be part of a multifunctional communications system. Gun key 402 has a transmitting device 404A which is operative to communicate only with gun lock 400. A separate gun key transmitting device 404B is operative to communicate with communications system 412. Similarly, gun key receiving device 406A is operative to communicate only with gun lock 400. Gun key receiving device 406B is operative to communicate with communications system 412. The communication system could be a server, a portion of a local communications network, the internet, a public telephone network or another system. The gun key could thus be either a standalone device, an "APP" or program running on a cell phone or a so-called smartphone or other multifunction communications device, or part of an APP or program. The figure shows control of 404A, 404B, 406A and 406B by logic device 408, associated with a memory device.

There has thus been shown and described a secure, smartphone-operated weapon lock which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Locking apparatus for preventing use of a gun or other weapon by any unauthorized person, said apparatus comprising:

(1) a gun lock device configured to be installed on a gun, said gun lock device including:

(a) a gun lock configured to be disposed on a gun and responsive to an electronic gun command signal to select a state from among at least two operative states, including a locked state which prevents firing the gun and an unlocked state which enables firing;

(b) a first data memory for storing first gun security data representing (i) gun key information pertaining to at least one gun key device that may be used to control the gun, and (ii) biologic personal information pertaining to at least one authorized person who is permitted to control the gun and thereby to select one of said locked and said unlocked operative states;

(c) a first data receiver for receiving a gun control signal including second gun security data; and (d) a first logic device, coupled to the first data receiver and to the first data memory, for (i) generating said second gun security data from said received gun control signal;

(ii) comparing said second gun security data with said first gun security data stored in said first data memory, and (iii) producing said electronic gun command signal to select one of said locked and said unlocked operative states when said first gun security data and said second gun security data are substantially the same; and (2) a gun key device for controlling the gun lock device, said gun key device comprising:

(a) a first data transmitter for transmitting said gun control signal to said first data receiver;

(b) a second data memory for storing said second gun security data representing (i) first gun key information pertaining to said gun key device, and (ii) said biologic personal information pertaining to at least one authorized person who is permitted to control the gun and thereby to select one of said locked and said unlocked operative states; and (c) a second logic device, coupled to each of said first data transmitter and said second data memory, for generating said gun control signal, including said second gun security data stored in said second data memory, for transmission to said first data receiver;

whereby the operative state of said gun may be changed only in an event that each of the gun key information and the biologic personal information transmitted by said first gun key device substantially matches the respective information stored in said first data memory, thereby to prevent control of the gun except by a properly identified gun key device and a properly authorized person.

2. The locking apparatus of claim 1, wherein said gun lock device further comprises a second data transmitter coupled to said first logic device and said gun key device further comprises a second data receiver coupled to said second logic device, and wherein:

(i) said second logic device is further operative to generate a gun key interrogation signal;

(ii) said first data transmitter is operative to transmit said gun key interrogation signal to said first data receiver;

(iii) in response to receipt of said gun key interrogation signal, said first logic device is further operative to generate a reply signal;

(iv) said second data transmitter is operative to transmit said reply signal to said second data receiver; and (v) said second logic device is operative to generate a gun control signal for transmission to said first data receiver in said gun lock device only if said reply signal is received in response to said interrogation signal.

3. The locking apparatus of claim 1, wherein said gun lock device further comprises a second data transmitter coupled to said first logic device and said gun key device further comprises a second data receiver coupled to said second logic device, and wherein:

(i) said first logic device is further operative to generate a gun lock interrogation signal;

(ii) said second data transmitter is operative to transmit said gun lock interrogation signal to said second data receiver;

(iii) in response to receipt of said gun lock interrogation signal, said second logic device is further operative to generate a reply signal;

(iv) said first data transmitter is operative to transmit said reply signal to said first data receiver; and (v) said first logic device is operative to produce an electronic gun command signal configured to unlock the gun and to provide said command signal to said gun lock only if said reply signal is received in response to said gun lock interrogation signal.

4. The locking apparatus of claim 2, wherein:

(i) said gun key interrogation signal includes first gun lock identification information pertaining to said gun lock device;

(ii) said first data memory is further operative to store second gun lock identification information, representing identification information of said gun lock; and (iii) said first logic device is further operative to compare said received first gun lock identification information with said stored second gun lock identification information and to provide said reply signal only if said received first gun lock identification information matches said stored second gun lock identification information.

5. The locking apparatus of claim 3, wherein:

(i) said gun lock interrogation signal includes first gun key identification information pertaining to said gun key device;

(ii) said second data memory is further operative to store second gun key identification information, representing identification information of said gun key device; and (iii) said second logic device is further operative to compare said received first gun key identification information with said stored second gun key identification information and to provide said reply signal only if said first gun key identification information matches said second gun key identification information.

6. The locking apparatus of claim 2, wherein:

(i) said first data memory is further operative to store first gun lock identification information, pertaining to said gun lock device;

(ii) said reply signal includes said first gun lock identification information;

(iii) said second data memory is further operative to store second gun lock identification information, representing each and every gun lock device that is allowed to communicate with said gun key device; and (iv) said second logic device is further operative to compare said received first gun lock identification information with said stored second gun lock identification information and to provide said gun control signal only if said received first gun lock identification information matches one of said stored second gun lock identification information.

7. The locking apparatus of claim 3, wherein:

(i) said second data memory is further operative to store first gun key identification information, pertaining to said gun key device;

(ii) said reply signal includes information representing said first gun key identification information;

(iii) said first data memory is further operative to store second gun key identification information, representing each and every gun key device that is allowed to communicate with said gun lock device; and (iv) said first logic device is further operative to compare said first gun key identification information included in said reply signal with said stored second gun key identification information and to provide said gun command signal only if said received first gun key identification information matches said stored second gun key identification information.

8. The locking apparatus of claim 2, wherein:

(i) said first logic device is further operative to cause said reply signal to include first gun key identification information; and (ii) said second logic device is further operative to compare said first gun key identification information included in said reply signal with stored second gun key identification information and to provide said gun control signal only if said received first gun key identification information matches said stored second gun key identification information;

thereby to provide said biologic personal information only when said reply signal is received from a gun lock which contains identification information of said gun key device.

9. The locking apparatus of claim 3, wherein:

(i) said first logic device is further operative to cause said reply signal to include first gun lock identification information; and (ii) said second logic device is further operative to compare said first gun lock identification information included in said reply signal with stored second gun lock identification information and to provide said gun control signal only if said first gun lock identification information matches said stored second gun lock identification information;

thereby to provide said biologic personal information only when said reply signal is received from a gun key which contains identification information of said gun lock.

10. The locking apparatus defined in claim 1, wherein said gun key device repeatedly provides said gun control signal.

11. The locking apparatus defined in claim 1, wherein said gun key device further comprises a first input device coupled to said second logic device, and wherein, in response to an inputted command, said second logic device causes said first data transmitter to transmit said command to said first data receiver, whereby said gun key device provides said gun control signal.

12. The locking apparatus of claim 1, wherein said gun key device further comprises an input device and wherein, in response to an inputted command, said gun key device repeatedly provides said gun control signal for a duration of time selected from the group consisting of:

(i) less than 1 minute;

(ii) a range of time from 1 minute to 5 minutes;

(iii) a range of time from more than 5 minutes to 30 minutes;

(iv) more than 30 minutes;

(v) 30 minutes to 24 hours;

(vi) 1 day to 1 week; and (vi) 1 week to 1 month.

13. The locking apparatus of claim 1, wherein said gun key device further comprises a second data transmitter and a second data receiver operative to communicate with a data communications system, thereby allowing said gun key device to perform at least one of a plurality of operative functions of a smartphone in which the gun key device resides.

14. The locking apparatus of claim 1, wherein said gun key device further comprises a third receiving device operative to communicate with a data communications system, and wherein said first data transmitter is further operative to communicate with said data communications system, thereby allowing said gun key device to perform at least one of a plurality of operative functions of a smartphone in which the gun key device resides.

15. The locking apparatus of claim 1, wherein said first data memory comprises at least one write-once-only element.

16. The locking apparatus of claim 1, wherein said second data memory comprises at least one write-once-only element.

17. The locking apparatus of claim 1, wherein said first logic device comprises at least one write-once-only element.

18. The locking apparatus of claim 1, wherein said second logic device comprises at least one write-once-only element.

* * * * *